United States Patent [19]

Heikkilä

[11] Patent Number: 4,936,025

[45] Date of Patent: Jun. 26, 1990

[54] COMBINATION INFRARED AND AIRBORNE DRYING OF A WEB

[75] Inventor: Pertti Heikkilä, Raisio, Finland

[73] Assignee: Valmet Paper Machinery Inc., Finland

[21] Appl. No.: 343,049

[22] Filed: Apr. 25, 1989

[30] Foreign Application Priority Data

Apr. 25, 1988 [FI] Finland ..... 881936

[51] Int. Cl.[5] ..... F26B 7/00

[52] U.S. Cl. ..... 34/18; 34/41; 34/60

[58] Field of Search ..... 34/4, 41, 23, 155, 156, 34/18, 17, 60, 242; 226/97; 68/5 E, 5 D

[56] References Cited

U.S. PATENT DOCUMENTS 4,513,516 4/1985 Bjornberg ..... 34/4

4,594,795 6/1986 Stephansen ..... 34/4

*Primary Examiner*—Henry A. Bennet

*Assistant Examiner*—John Sollecito

*Attorney, Agent, or Firm*—Steinberg & Raskin

[57] ABSTRACT

Method and device in a drying of a moving web, in which the web is passed while being supported free of contact through various drying gaps in which the web is dried by infrared radiation and air blowing. The web is passed into an infrared treatment gap in which infrared radiation is applied to the same, preferably from gas-operated infrared-radiation elements. Cooling air of the infrared unit is blown into the treatment gap and towards the web. After the infrared treatment gap, the web is immediately passed into an air drying gap within which the web is dried by way of air blowings which, at the same time, support the web free of contact. The cooling air and possibly combustion gases from the infrared unit are passed through a web inlet opening of the airborne web dryer unit into an interior of the box of the airborne unit to constitute part of its circulating air. The cooling air required by the infrared unit is passed into the infrared unit out of a pressure compartment of the airborne unit.

9 Claims, 1 Drawing Sheet

COMBINATION INFRARED AND AIRBORNE DRYING OF A WEB

BACKGROUND OF THE INVENTION

The invention concerns a method in the drying of a moving web, such as a paper or board web, in particular in drying that takes place in connection with surface treatment or coating, in which the web is passed while being supported free of contact through various drying gaps in which the web is dried by means of infrared radiation and air blowings.

Furthermore, the invention concerns a combination dryer intended for carrying out the method herein, this combination dryer comprising an infra or infrared unit and an airborne web dryer unit integrated in its connection (i.e. connected thereto), the web being passed through the treatment gaps in these units while being supported free of contact by means of air blowings and while being dried by means of the infrared radiation and the air blowings. The combination dryer also comprises a circulation system for drying air and for the cooling air of the infrared dryer unit, and possibly also for combustion air. This circulation system comprises an outlet duct for circulation air and an inlet duct for circulation air, with blower equipment and possibly also heating equipment for circulation air, preferably a gas burner, being connected between these inlet and outlet ducts.

As is known in the prior art, paper webs are coated either by means of separate coating devices, by means of on-machine devices integrated in paper machines, or by means of surface-sizing devices which operate in a drying section of a paper machine so that the web to be coated is passed at the final end of a multi-cylinder dryer to a coating device, which is followed by an intermediate dryer and finally, e.g., by one group of drying cylinders as an after-dryer.

A typical application of the present invention is exactly in such an intermediate dryer situated after a coating device, to which however, the present invention is not to be confined.

In the prior art, so-called airborne web dryers are known in which a paper web, board web, or equivalent is dried free of contact. Airborne web dryers are used, e.g., in paper coating devices after a blade, roll or spread coater to support and to dry the web that is wet with the coating agent, free of contact.

In airborne web dryers, different blow nozzles for the drying and supporting air as well as arrangements of the same are applied. Such blow nozzles can be divided into two groups, i.e. positive-pressure or float nozzles and negative-pressure or foil nozzles.

The prior art airborne web dryers that are most commonly used are based exclusively on air blows. It is partly for this reason that the airborne web dryer becomes quite spacious or large-scaled, because the distance of effect of the airborne web dryer must be relatively long in order that a sufficiently high drying capacity could be obtained. A partial reason for these drawbacks is that in air drying, the energy density of the drying remains relatively low.

In the prior art, different dryers are also known which are based, e.g., on the effect of infrared radiation. The use of infrared radiation provides the advantage that the radiation has a relatively high energy density, which is increased when the wave length becomes shorter. The use of infrared dryers in the drying of a paper web has been hampered, e.g., by the risk of fire, because the temperatures in infrared radiators and in the environment become quite high in order that a drying radiation with a sufficiently short wave length can be achieved.

In a manner known in the prior art, in infrared dryers the thermal energy is supplied to the device either as electricity or as natural gas. The cost ratio between electricity and natural gas varies, so that the economy of use also varies. In electric infrared dryers, cooling air is required, whereas in gas infrared dryers combustion air is required which can, at the same time, for its part, also act as cooling air for the parts that become hot.

Due to the drawbacks described above, the starting point of the present invention has been an integrated combination of an infrared dryer and an airborne web dryer, in which most of the various advantages of these two dryers are carried into effect.

In the present invention, a gas-operated infrared unit is expressly intended to be used, because in such a case the advantages that are aimed at by way of the present invention are manifested best. In certain particular cases however, the present invention is also suitable, at least after certain modification, for application in conjunction with infrared units operating by means of electricity.

With respect to the prior art related to the present invention, reference is made to the previous Valmet FI Patent Applications Nos. 862427 and 872504. With respect to the prior art most closely related to the present invention, reference is made to the recent Valmet FI Patent Application No. 881603, entitled "Gas-Infrared Airborne-Web Dryer", by Sture Ahlskog.

SUMMARY OF THE INVENTION

Accordingly, it is an object of the present invention to provide a method and a combination dryer by means of which operation and construction of a gas-infrared-airborne-web-dryer combination can be simplified to a considerable extent.

It is also an object of the present invention to provide a combination dryer in which the number of circulation air ducts can be substantially reduced, so that more space can be provided around the dryer, with the intention being to make functions such as operation, servicing and cleaning in conjunction with the dryer, much easier.

It is an additional object of the present invention to provide a combination dryer that is very suitable for modernizing drying sections in which, as a rule, attempts are made to essentially increase the drying capacity, but with the dryer having to be fitted in a space which is usually quite limited in the dryer being modernized.

It is a further object of the present invention to provide a combination dryer in which the number of regulating dampers is lower than in prior art dryers, so that the control and operation are simpler than in the prior art drying functions.

These and other objects are attained by the present invention which is directed to a method in drying of a moving web such as a paper or board web, in which the web is passed while being supported free of contact through various drying gaps in which the web is dried by means of infrared radiation and gas blowing, comprising a combination of the steps of passing the web into an infrared treatment gap in which infrared radiation is applied to the web from an infrared unit, blowing cooling gas of the infrared unit into the treatment gap and towards the web, passing the web substantially immediately after the infrared treatment into an air-drying gap within which the web is dried by gas blowings from an airborne web dryer unit which at the same time support the web free of contact, passing the cooling gas from the infrared unit through a web inlet opening of the airborne web dryer unit into an interior thereof to constitute part of circulating gas within the airborne web dryer unit, and passing the cooling gas required by the infrared unit out of a pressure compartment of the airborne unit and into the infrared unit.

The drying of the web preferably takes place in connection with surface treatment or coating of the web, with infrared radiation preferably being applied to the web from gas-operated infrared radiation elements in the infrared unit, and the combustion gas from the infrared unit being preferably passed through the web inlet opening of the airborne web dryer unit.

The present invention is also directed to a device for drying a web which comprises a combination of an infrared unit and an airborne web dryer unit integrated or connected together, with the web being passed through respective treatment gaps of the units while supported free of contact by means of gas blowings, and being dried by means of infrared radiation and the gas blowings, along with a circulation system for the drying gas and cooling gas for the infrared dryer unit. The circulation system comprises an outlet duct and an inlet duct for circulating gas, and blower means disposed between the inlet and outlet ducts for circulating the gas. In a direction of travel of the web, the infrared unit is arranged first, and then the airborne unit is arranged which is directly integrated with or connected to the infrared unit. The infrared unit is provided with at least one nozzle arrangement through which gas blowing can be directed, in the respective infrared drying gap towards the web passing thereby. After the infrared unit, an inlet opening is directly formed in a front wall of the airborne unit for the web. This opening is arranged such that the gas blowing for the infrared nozzle arrangement is at least partially passed into the airborne unit, being partially induced by the passing web. Furthermore, a gas duct passes from the airborne unit to the infrared unit.

The circulation system also preferably circulates combustion gas for the infrared unit, with heating means also preferably being disposed between the inlet and outlet ducts for heating the circulating gas. Preferably, the infrared unit comprises a plurality of nozzle arrangements. The inlet opening is arranged to direct the gas blowing from the infrared nozzle arrangement into a nozzle box of the airborne unit, with the gas duct to said infrared unit preferably passing out from the inlet duct.

Therefore, in view of achieving the objects described above and those which will become apparent below, the method of the present invention is principally characterized by comprising a combination of the following steps:

(a) The web is passed into an infrared treatment gap in which infrared radiation is applied to the web, preferably from gas-operated infrared-radiation elements;

(b) into this treatment gap, cooling air of the infrared unit is blown towards the web;

(c) after this infrared treatment gap, the web is passed substantially immediately into an air-drying gap within the area of which the web is dried by means of air blowings, and by means of which the web to be dried is at the same time supported free of contact;

(d) the cooling air, and possibly combustion gases from the infrared unit, are passed through the web-inlet opening of the airborne web dryer unit to an interior of a box of the airborne unit to constitute part of its circulating air; and (e) the cooling air required by the infrared unit is passed into the infrared unit out of a pressure compartment of the airborne unit.

On the other hand, the device in accordance with the present invention is principally characterized by, in a direction of travel of the web, comprising first and infrared unit and then an airborne unit directly integrated with the infrared unit. The infrared unit is provided with nozzle arrangements, through which air blowings can be directed in the infrared drying gap towards the web passing by. After the infrared unit, directly in a front wall of the airborne unit, there is an inlet opening for the web, which is fitted in such a way that the blowings that arrive from the nozzles of the infrared unit are passed, partially induced by the web, into the nozzle box of the airborne unit. Furthermore, a short air duct is passed into the infrared unit out of a pressure compartment of the airborne unit, preferably out of the inlet air duct.

The combustion air necessary in the gas-infrared unit of the combination dryer of the present invention as well as the circulation air, by means of which the evaporated water vapor and the flue gases are carried away and the device is cooled, are, according to the present invention, taken directly from the pressure compartment of the airborne web dryer unit. This is the reason why it is unnecessary to pass a separate air duct from the blower compartment to the infrared unit of the dryer.

According to the present invention, the return air of the infrared unit is passed, or most advantageously it is allowed to flow directly, through the web inlet opening in the airborne web dryer box and into the airborne box so that a separate return air duct is not required in the infrared unit.

By means of the present invention, remarkably advantages are attained in practice, such as separate circulation air ducts not being required for the infrared unit, and the infrared unit being an integrated part of the circulation air system of the airborne web dryer unit, and not having to be adjusted separately. Due to the lower number of ducts, there is more space around the dryer, which facilitates the operation, servicing, and cleaning, and due to a lower number of regulating dampers, the operation of the overall device is much simpler than in the prior art.

BRIEF DESCRIPTION OF THE DRAWINGS

The present invention will be described below in greater detail with reference to certain exemplary embodiments thereof illustrated in the accompanying drawings, and to which the present invention is by no means intended to be strictly confined. In the drawings.

DESCRIPTION OF THE PREFERRED EMBODIMENTS

Figure 1:
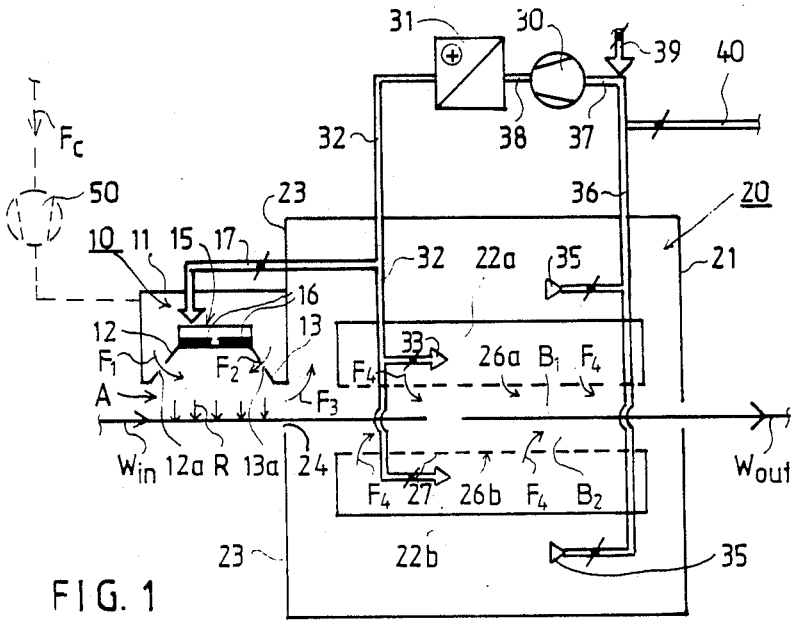
FIG. 1 is a schematic side view of a first embodiment of the present invention.
Figure 2:
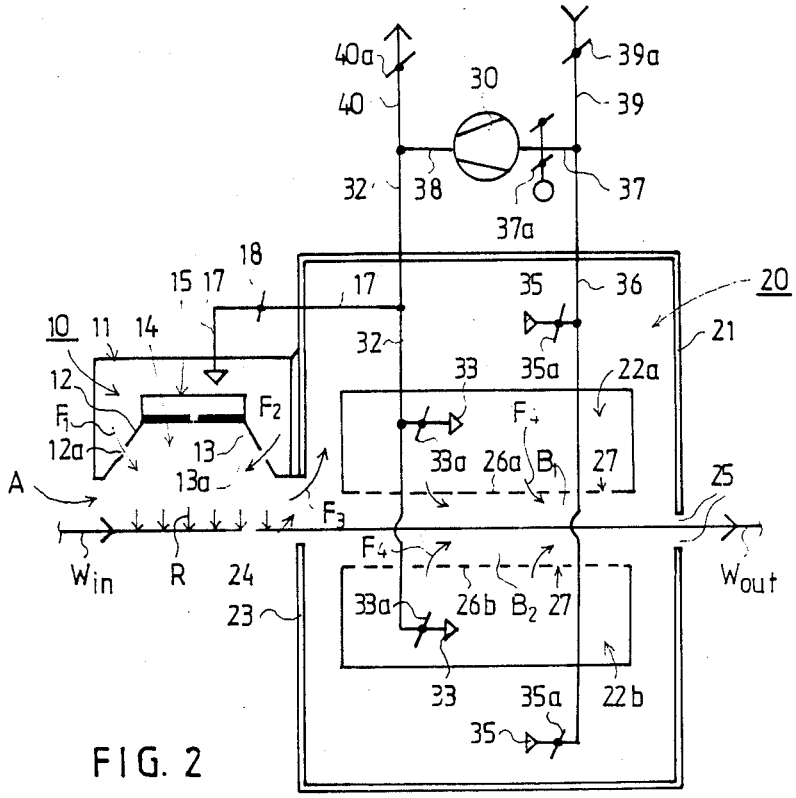
FIG. 2 illustrates a second embodiment of the present invention in a manner corresponding to FIG. 1.

By means of the gas-infrared-airborne-web dryer combination 10, 20 illustrated in FIGS. 1 and 2, the moving web W is dried free of contact. The web arrives in the dryer in the direction $W_{in}$ and leaves the dryer in the direction $W_{out}$. In the dryer, in the direction of arrival $W_{in}$ of the web, there is first a gas-infrared unit 10 and an airborne web dryer unit 20 directly connected thereto. The gas infrared unit 10 forms a one-sided infrared-dryer gap A, which is followed by the two-sided air-drying gaps $B_1$ and $B_2$ in the airborne unit 20.

As is shown in FIGS. 1 and 2, the infrared unit 10 comprises a box 11, which extends across the entire width of the web W. In the box 11, a radiated unit 15 is situated which comprises several infrared-radiation elements 16 situated side by side in the transverse direction of the web, these elements being in this case, gas burners. Below the radiation unit 15, the box 11 is provided with diagonal walls 12 and 13 which open downwardly and which define a radiation space 14 expanding downwardly from the level of the radiation elements 16. The radiation R is directed at the by-passing web W through this radiation space. At the side of the web W opposite to the infrared unit 10, there may be a second, corresponding radiation unit if it is necessary to dry the web W two-sidedly at one time by means of radiation.

In order to be able to operate, the infrared unit 10 required combustion air and circulation air for the cooling of the radiation elements 16 and of the parts situated in their proximity. For this purpose, the box 11 of the unit 10 is connected to an air inlet duct 17 provided with a regulation damper 18, with the combustion and cooling air being supplied through this duct 17. The combustion air may also be supplied by means of a blower of its own. The air circulates in the environment of the radiation elements 16 and is removed through the openings 12*a*, 13*a* in walls 12, 13 as blowings $F_1$ and $F_2$ opposite to one another, and directed diagonally towards the web W. For the blowings $F_1$ and $F_2$, the walls 12 and 13 are provided with the nozzle slots 12*a* and 13*a* respectively, or with corresponding series of nozzle holes.

The airborne web dryer unit 20 illustrated in FIGS. 1 and 2 and integrated in connection with the infrared unit 10, comprises an airborne web dryer box 21, with the infrared unit 10 being directly connected to a front wall 23 thereof. Inside the airborne web dryer box 21, there are two opposite nozzle units 22*a* and 22*b* respectively, whose carrier faces 26*a* and 26*b* respectively define an air drying supporting gap $B_1$ and $B_2$, for the web W at each respective side of the web W. Through the nozzle slots 27 in the carrier faces 26*a* 26*b* which are illustrated only schematically in FIGS. 1 and 2, blowings $F_4$ are passed which dry and at the same time carry the web W free of contact, as the web runs through the gaps $B_1$, $B_2$. It is possible to use positive-pressure or negative-pressure nozzles known in and of themselves as the nozzles 27, reference being made with respect to the details of the construction of such nozzles to the Valmet FI Pats. Nos. 68,723 and 60,261 (corresponding to U.S. Pat. Nos. 4,247,993 and 4,384,666). The airborne web dryer box 21 is provided with an inlet opening 24 and an outlet opening 25 for the web W.

There may be one or several dryer combinations 10, 20 of the type illustrated in FIGS. 1 and 2 situated one after the other, e.g. two such combinations situated one after the other, in which case the infrared units 10 are most appropriately situated at opposite sides of the web W.

The air circulation systems of the combination dryers illustrated in FIGS. 1 and 2 will be described below. The circulation air for the infrared unit 10 and also possibly the combustion air, are taken through the inlet air ducts 17 directly out of a pressure compartment of the airborne web unit 20 which is, in FIGS. 1 and 2, represented and illustrated by the pressurized inlet duct 32 for the circulation air of the airborne web unit. If necessary, the inlet air duct 17 is provided with a regulation damper 18. This is the reason why it is unnecessary to provide a separate duct from the blower chamber to the infrared unit 10.

The return air of the infrared unit 10 which comprises the blowings $F_1$ and $F_2$, is allowed to pass through the web opening 24 above the web W, being partially induced by the web W, and into the interior space in the airborne web dryer box 21. Thus, a separate return air duct is not required in the infrared unit 10. According to the present invention, the air circulation of the infrared unit 10 is integrated as an organic part of the air circulation system of the airborne web unit so that, for example, it does not have to be adjusted separately.

The circulation air system or the airborne unit 20 includes an inlet air duct 32 and an outlet air duct 36. The inlet air duct 32 is opened through regulation dampers 33*a* and 33 into the blow boxes of the nozzle units 22*a* and 22*b*, from which the air passing through the duct 32 is discharged through the nozzles 27 as blowings $F_4$ in connection with the web W. The blowings $F_4$ are collected into the airborne web dryer box 21, from which the outlet air suctioned by the blower 30 is taken through the ducts 35 and the regulation dampers 35*a* and into the outlet air duct 36. The replacement air is taken through the duct 39. If necessary, the duct 39 is provided with a regulation damper 39*a*. The suction duct 37 of the blower 30 is provided with a regulating grating 37*a*. The outlet air is passed through the duct 40 which is, if necessary, provided with a regulating damper 40*a*.

As is illustrated in FIG. 1, a duct 38 at the pressure side of the blower 30 communicates with the gas blower 31, in which the air is heated to the suitable temperature level, e.g. T=about 100°–400° C., before the air is passed into the inlet air duct 32 of the airborne web unit 20. According to FIG. 2, the air system does not include a gas burner or any other air heating device, however in the combination dryer 10, 20 all required thermal energy is obtained from the cooling air and combustion gases of the infrared unit 10, being supplied by the blowings $F_1$, $F_2$, $F_3$. In other words, the thermal energy required in the circulation air of the infrared airborne web dryer combination, is taken substantially exclusively from the cooling air of the infrared unit 10, and possibly from the combustion gases of a gas infrared unit.

In FIG. 1, an additional blower 50 is illustrated by dotted-dashed lines. This blower 50 is connected to the infrared unit 10 if required. By means of the blower 50, it is possible to supply the necessary amount of additional cooling air into the box 11 of the infrared unit 10.

The web opening 24 through which the flow $F_3$ is introduced into the airborne web box, is preferably arranged adjustable so that its flow resistance becomes suitable in view of the overall operation and the pressure levels of the system. The web W inlet opening 24 at the airborne web units 20, through which the air from the blowings $F_1$, $F_2$ in the preceding infrared unit 10 have been passed into the airborne web box 21, from which the air is further passed through the ducts 35 into the outlet duct 36, is provided with a regulation device, by means of which the flow resistance in the opening 24 can be set to the appropriate level.

The inlet side $W_{in}$ of the web acts as a type of air carrier in the area of the radiation drying gap A, this carrier, for its part, inducing the blowings $F_1$ and $F_2$ through the web opening 24 as the flow $F_3$ into the airborne web box 21, so that substantially large leakages of gas cannot arise. In this manner, all the thermal energy transferred from the infrared unit 10 into the cooling air and combustion gases can be efficiently recovered.

It is preferred that the amount or velocity of the blowing $F_1$ inclined with the running direction of the web W, is higher than that of the blowing $F_2$ inclined against the running direction of the web, which contributes to the formation of an air curtain in the area of the inlet side the web $W_{in}$ and of the infrared unit 10.

Even though an air system and circulation air have been described above, it is to be understood that in conjunction with the various airs circulating in the system, there may also be other gases such as water vapor and combustion gases.

According to the present invention, when the infrared unit 10 and the airborne web unit 20, as well as their air systems are integrated with each other in the manner described above, a combination dryer is obtained which has a small size, which is of particular importance in the case of modernizing dryers.

Various details of the present invention may vary according to the inventive concepts described above, which have been presented for the sake of example only. In other words, the preceding description of the present invention is merely exemplary, and is not intended to limit the scope thereof in any way.

What is claimed is:

1. Method in drying of a moving web such as a paper or board web, in which the web is passed while being supported free of contact through various drying gaps in which the web is dried by means of infrared radiation and gas blowing, said method comprising a combination of the steps of passing the web into an infrared treatment gap in which infrared radiation is applied to the web from an infrared unit, blowing cooling gas of said infrared unit into said treatment gap and towards the web, after said infrared treatment, passing the web substantially immediately into an air-drying gap within which the web is dried by gas blowings from an airborne web dryer unit which, at the same time, support the web free of contact, passing the cooling gas from said infrared unit through a web-inlet opening of said airborne web dryer unit and into an interior thereof, to constitute part of circulating gas within the airborne web dryer unit, and passing the cooling gas required by said infrared unit out of a pressure compartment of said airborne unit and into said infrared unit.

2. The method of claim 1, wherein said drying of the web takes place in connection with surface treatment or coating of the web, said infrared radiation is applied to the web from gas-operated, infrared radiation elements in said infrared unit, and combustion gas from said infrared unit is passed through said web inlet opening of said airborne web dryer unit.

3. The method of claim 1, comprising the additional steps of circulating gas from an outlet duct of said airborne unit to an inlet duct of said airborne unit, with a blower device, removing both said cooling gas of said infrared unit and said gas for said drying and supporting blowings in said airborne unit from said inlet duct, and removing the gas blown towards the web in the infrared unit and passing with the same through said web inlet opening of said airborne unit and into the airborne unit, from inside of said airborne unit through ducts and into said outlet duct of the airborne unit.

4. The method of claim 1, comprising the additional step of directing gas blowings towards the web in the infrared unit at least partially towards one another, whereby quantity of a gas blowing inclined towards a direction of movement of the web is larger than quantity of a gas blowing of substantially opposite inclination.

5. The method of claim 1, comprising the additional step of heating circulating gas of a combination of said infrared and airborne dryer units, with a gas burner.

6. The method of claim 3, comprising the additional step of heating said circulating gas by means of a gas burner arranged at a pressure side of said blower.

7. The method of claim 1, comprising the additional step of taking thermal energy required in circulation of gas through a combination of said infrared unit and airborne web dryer unit, substantially exclusively from the cooling gas of said infrared unit.

8. The method of claim 2, comprising the additional step of taking thermal energy required in circulation of gas through a combination of the infrared unit and airborne web dryer unit, substantially exclusively from the cooling gas of said infrared unit and the combustion gas of said infrared unit.

9. The method of claim 1, wherein said infrared radiation is first applied to the web one-sidedly, and then said supporting and drying gas blowings are applied two-sidedly in the airborne unit.

* * * * *